United States Patent [19]

Karlin

[11] 4,188,006

[45] Feb. 12, 1980

[54] STEADYING REST TO AID IN STEADYING AN ARTIST'S HAND

[76] Inventor: Robert Karlin, 38106 Village #38, Leisure Village, Camarillo, Calif. 93010

[21] Appl. No.: 875,228

[22] Filed: Feb. 6, 1978

[51] Int. Cl.[2] ..... B43L 15/00

[52] U.S. Cl. ..... 248/118.3; 403/392; 403/400

[58] Field of Search ..... 248/51, 118, 118.1, 248/118.3, 118.5, 226.4; 403/392, 400; 35/36; 108/50

[56] References Cited

U.S. PATENT DOCUMENTS

| | | | |
|---|---|---|---|
| 2,496,276 | 2/1950 | Dolas | 248/118.3 |
| 2,831,655 | 4/1958 | Hammer | 403/392 X |
| 3,902,931 | 9/1975 | Danciger | 248/226.4 X |
| 4,088,290 | 5/1978 | Novello | 248/118.5 |

FOREIGN PATENT DOCUMENTS

| | | | |
|---|---|---|---|
| 61454 | 6/1891 | Fed. Rep. of Germany | 248/118.3 |
| 465446 | 9/1928 | Fed. Rep. of Germany | 248/226.4 |
| 806049 | 7/1949 | Fed. Rep. of Germany | 403/400 |
| 238317 | 10/1945 | Switzerland | 248/51 |

*Primary Examiner*—William H. Schultz
*Attorney, Agent, or Firm*—Robert E. Geauque

[57] ABSTRACT

A steadying rest to aid in the steadying of an artist's hand above a two-dimensional work surface, such as a canvas, is comprised of offset members which are temporarily fixed to the work surface, typically along the edges. A first rest member is adjustably coupled to two of the offset members. A second rest member may be adjustably coupled to the third offset member and to the first rest member. By arbitrary placement of the offset members with respect to the work surface and appropriate coupling of the rest members with respect to each other, a two-dimensional steadying rest can be arbitrarily placed adjacent to the work surface to provide a means to steady the artist's hand while painting or drawing fine details on the work surface adjacent thereto.

7 Claims, 4 Drawing Figures

STEADYING REST TO AID IN STEADYING AN ARTIST'S HAND

BACKGROUND OF THE INVENTION

1. Field of the Invention

The present invention relates to the field of mechanical aids for graphic design work and in particular relates to steadying rests used by artists in connection with painting or drawing.

2. Description of the Prior Art

The need for mechanical devices to aid the artist to accurately and quickly paint fine detail of original works of art or graphic design has long been appreciated in the art. Typically, in the area of graphic design, such devices have included various types of attachments to paint brushes which would aid the artist in drawing regular curved or straight lines such as shown in U.S. Letters Pat. No. 607,248; U.S. Letters Pat. No. 3,037,231; U.S. Letters Pat. No. 1,697,756; or U.S. Letters Pat. No. 3,114,166. Other types of mechanical devices attached to paint brushes has allowed the paint brush to be offset by a predetermined amount from a given surface, such as a window pane, to aid the painter in painting the adjacent sash or to exclude the deposit of paint on the adjacent pane, such as shown in U.S. Letters Pat. No. 2,947,018; U.S. Letters Pat. No. 2,712,667; or U.S. Letters Pat. No. 2,610,344.

In the field of original works of art, it has long been appreciated that painting or drawing of detailed and finely designed portions of a work of art can be facilitated by the use of a mahl stick. The mahl stick consists of a simple rod held at one end in the artist's hand and rested on the other end against the canvas surface or framing edge. The artist places the remaining free hand against the upper portion of the mahl stick which serves as a steadying rest to allow the large muscles of the hand, wrist and arm of the artist's painting hand to relax, thereby permitting free use of the fine muscles of the hand and fingers for detailed artwork. A similar or less effective means for steadying the painting hand can also be achieved to a limited extent by grasping the wrist of the painting hand with the remaining free hand. In either case, the continued use of both of the artist's hands are required to obtain the steadying effect upon the painting hand. This continued muscular tension, however, leads to fatigue and cannot be maintained for long, continuous periods. Furthermore, the use of both of the artist's hands are required by such prior art procedures or devices and thus, forcloses the option to the artist to hold a pallet or any other item necessary or useful to the task.

Therefore, what is needed is an apparatus which overcomes each of the stortcomings of the prior art and which will allow the artist free use of both hands for continuous and prolonged periods without the early inducement of muscular fatigue.

BRIEF SUMMARY OF THE INVENTION

The present invention is an apparatus providing the steadying rest adjacent to a work surface having at least two dimensions. The apparatus comprises: offset members; means for temporarily coupling each of the offset members to a select position adjacent to the work surface; and a first rest member adjustably coupled to the offset members, which rest member provides the steadying rest. By virtue of this combination, the steadying rest can be adjustably positioned in the proximity of substantially any point of the work surface without the necessity of continued manual assistance.

The apparatus of the present invention may further comprise a third offset member and a second rest member adjustably coupled to the first rest member wherein the means which temporarily couples the offset members to a position adjacent the work surface also temporarily couples a third offset member to a selected position adjacent the work surface. By reason of this combination an apparatus is configured to provide at least a two-dimensionally extending steadying rest in a proximity of substantially any point on the work surface.

The offset members may be adjustably coupled to the rest member by a coupling means for binding the offsetted rest members together while permitting relative rotation and translation of the members. When more than one rest member is employed, the rest members may also be coupled one to the other by the same coupling means. In one embodiment, the coupling means is a resilient endless loop tightly encircling the offset and rest members.

One of the embodiments for the means, which temporarily couples the offset members to a select position adjacent the work surface, may be comprised of a bracket and a screw engaging a bracket to form in combination a clamp. The offset member extends from the bracket in the same general direction as the screw or may be one and the same so that when the bracket is clamped by means of the screw to the work surface, it can be laid against a flat board without interference from the clamp.

These and other embodiments of the present invention are better understood by viewing the following figures in light of the detailed description of the preferred embodiments.

DETAILED DESCRIPTION OF THE PREFERRED EMBODIMENTS

The present invention is a steadying rest to aid in steadying an artist's hand over a two-dimensional work surface, such as a canvas stretch over a frame. The steadying rest is comprised of at least three offset members, means for temporarily fixing each of the offset members with respect to the work surface, and at least two rest members adjustably coupled to the offset members. Typically, the two rest members are also adjustably coupled one to the other. In the preferred embodiment one of the rest members is adjustably coupled between two of the offset members thereby forming a rigid bar over the work surface. The other rest member, also a rigid bar, is adjustably coupled to a third one of the offset members and to the remaining rest member to provide a two-dimensional steadying rest over the work surface. The offset members can be adjustably coupled to the rest members by means of a resilient endless loop tightly encircling the offset and rest members binding the offset and rest members together while still permitting relative rotation and translation of the members. The two rest members can be similarly each coupled.

Figure 1:
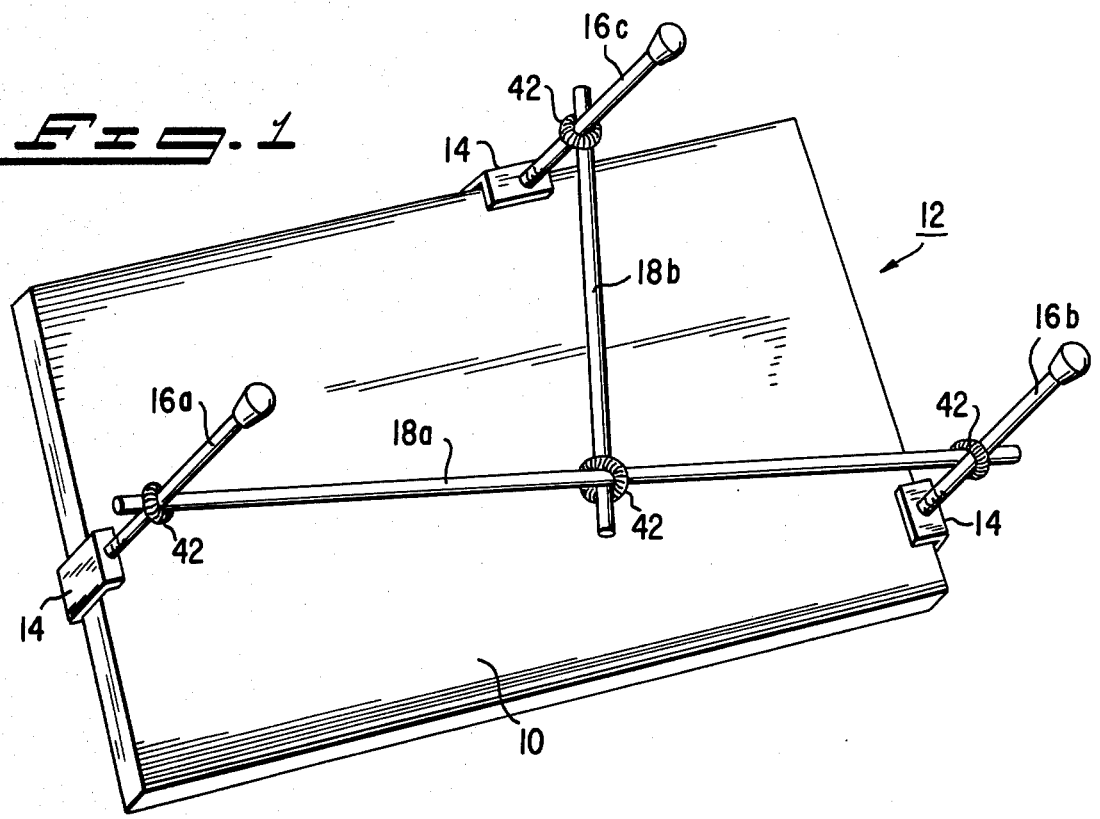
FIG. 1 is a perspective view of one embodiment of the present invention showing a two-dimensional steadying rest disposed above a flat canvas surface.

FIG. 1 shows a perspective view of one embodiment of the present invention. A two-dimensional work surface 10, such as a canvas stretched across a frame provides the work object. It must be understood that the particular type of work object shown is only for the purposes of illustration and that the present invention to be used upon many other types of media than canvas, such as masonite, thin canvas board, glass, plastic, and even complex three-dimensional curved surfaces. Depending upon the type of work surface it is to be understood that the means by which the present invention is coupled to the work surface may have to be modified and altered by the use of conventional principles known to those of ordinary skill in the art. The steadying rest 12 is coupled to work surface 10 by a means 14. Means 14 are coupled to a plurality of offset members 16, three of which are shown in FIG. 1. Means 14 temporarily couples each of the offset members 16 to a selected and arbitrary position adjacent, near, at or on work surface 10. In the embodiment illustrated in FIG. 1, means 14 attach member 16 to work surface 10 by coupling members 16 to the edges of the wooden framing across which the canvas is stretched.

Offset members 16 are adjustably coupled to rest members 18, two of which are shown in FIG. 1. In the illustrated embodiment a first rest member is a rigid rod 18*a* coupled between offset member 16*a* and 16*b*. A second rest member 18*b* is adjustably coupled between offset member 16*c* and an arbitrary point on rest member 18*a*.

It may now be readily appreciated that by appropriately selecting a position by which each of the means 14 are coupled to work surface 10 and by appropriate selection of the couplings between rest members 18*a* and 18*b*, the two-dimensional steadying rest provided by this combination of elements can be arbitrarily placed above work surface 10. Similarly, by arbitrarily adjusting the point of coupling between offset members 16 and rest members 18, rest members 18 may be placed at a distance offset from work surface 10 by an arbitrary amount and at an arbitrary inclination limited only by the extent of offset members 16.

Therefore, when in use, the artist adjusts rest members 18*a* and 18*b* at the desired location above work surface 10 and at the appropriate distance offset from work surface 10 to allow the artist to rest his working hand against one or both of rest members 18 while painting or tooling fine or detailed work on the location of work surface 10 proximately located below. It is also possible that the artist may remove rest member 18*b* and adjust rest member 18*a* adjacent the work surface to permit its use as a linear rule in the case where rest member 18*a* is a straight rigid rod. However, it must be noted that rest members 18 may assume any form well known to the art, including curved or linear rigid rods where appropriate. For example, when painting a hemispherical surface it may be desirable to have rest members 18*a* and 18*b* shaped in the form of appropriate circular arcs.

Although means 14 have been shown as attaching offset member 16 to the edges of work surface 10 it must be understood that means 14 need not directly attach to work surface 10 but may be proximate, adjacent or near the work surface or in other cases may actually be on, in or embedded in work surface 10. For example, one or more of means 14 may include a pedestal type mounting which may be fixed to or merely rest upon work surface 10. Although it is to be preferred that all three coupling means 14 as illustrated in FIG. 1 be rigidly and temporarily affixed to work surface 10, it is possible that one or more such means may have a nonrigid coupling to work surface 10 in appropriate applications.

Figure 2:
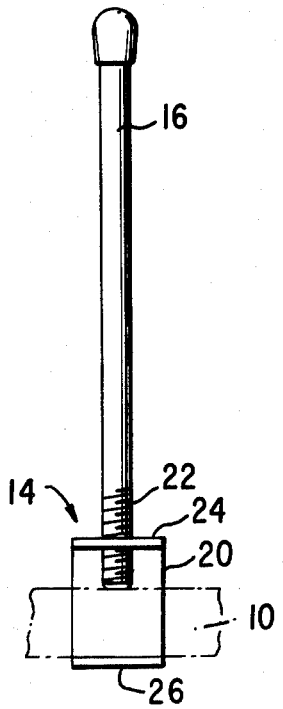
FIG. 2 is a detailed plan view of one embodiment of the means whereby the offset members are temporarily coupled to the work surface. The embodiment illustrated shows a clamp comprised of a bracket and screw wherein the screw is provided on one end of the offset member.

FIG. 2 illustrates in plan view one embodiment of means 14 which may be used to couple offsetting members 16 to the edge of a flat two-dimensional surface. A clamp is formed by the combination of a bracket 20 with a screw 22. The screw is led through end 24 of bracket 20 through which offset member 16 also extends. Thus, screw 22 advances and retreats during this adjustment in bracket 20 in the same direction as offset member 16. It would also be possible to provide a separate screw 22 apart from offset member 16 by offsetting the attachment of member 16 with bracket 20. The thickness of the wooden frame stretching the canvas or the canvas board, masonite or other work surface is then clamped between the opposing surfaces of bracket 20 and screw 22 as in a conventional vice. There is no substantial projection beyond end 26 of bracket 20 so that, when the means 14 of FIG. 2 is employed to couple offset member 16 to work surface 10, the rear surface of work surface 10 can lie in a flat or substantially flat manner against a solid board or other flat supporting substrate, such as an open frame easel or support.

Figure 3:
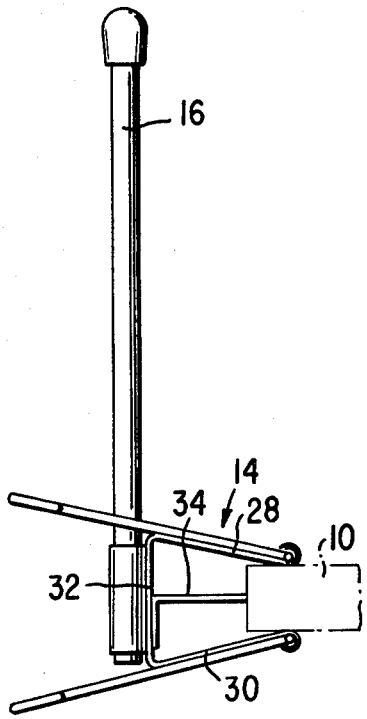
FIG. 3 is a side view of a spring clip which is another embodiment of the means by which the offset members may be temporarily coupled to the work surface.

FIG. 3 illustrates a side view of another embodiment of means 14 wherein a spring clip is employed to temporarily attach offset member 16 to the side of the work object. Spring clip is comprised of two mating spring leaves 28 and 30 which are urged together by the natural resiliency of leaves 28 and 30 in combination with a spring backing 32 which forms an integral piece with leaves 28 and 30. A spacer 34 is provided extending from backing 32 to the proximity of the mating line between leaves 28 and 30. Thus, the sides of the work object can be inserted into the spring clip only to the degree permitted by spacer 34. Inasmuch as leaves 28 and 30 together with spacer 34 have a parallel vertical dimension out of the plane of the drawing of FIG. 3, the lateral edge of 34 abuts the corresponding flat and straight edge of the canvas frame thereby ensuring the orientation of the spring clip not only with a uniform depth of bite on work surface 10 but in a parallel manner. The abutment of spacer 34 at the side of the work object tends to maintain the spring clip in a parallel engagement even when inadvertently pushed or pulled. By this means, the bit of leaves 28 and 30 against work surface 10 is maintained along the full length of the spring clip and the degree of security of attachment is increased.

Figure 4:
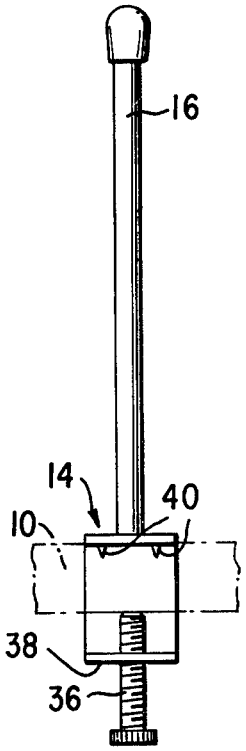
FIG. 4 is a plan view of yet another embodiment of the means by which the offset members may be coupled to the work surface, wherein a clamp is comprised of a bracket and a screw leading through the bracket in a direction opposite to that in which the offset member extends.

FIG. 4 illustrates yet another embodiment of means 14 which is similar to the embodiment illustrated in FIG. 2. However, the clamp formed by screw 36 and bracket 38 is oriented such that screw 36 extends from bracket 38 in a direction generally opposite to that in which offset member 16 extends. The bracket of FIG. 4 allows the advantage of free access to screw 36 without interference from offset member 16 and may be of general use in those applications where a open frame easel is used to support the work object, thereby allowing extension of means 14 beyond the rear surface of work surface 10. The embodiment of FIG. 4 also illustrates the use of a pair of pins 40 which provide shallow penetration into the edge of work surface 10 in order to securely anchor means 14 to the desired location. Any physical damage or imperfection caused by such pins or by the clamp itself is tolerable inasmuch as the edge of work surface 10, even in the case where the canvas extends to the edge, is generally hidden by the display frame into which the canvas is mounted. Pins 40 could similarly be employed in the embodiments of FIGS. 2 or 3.

It can also be appreciated that the means by which rest members 18 are coupled one to each other and to offset members 16 must provide for free and unencumbered rotation of one member with respect to the other as well as translation. Members 18 are round plastic, wooden or metal dowels such that there is no preferred contact configuration between the members as would be the case with any other shape having one or more flat sides. The circular cross sections permit arbitrary placement of members 16 and 18 with respect to each other without any substantial difference on the degree of extension of endless loop 42. In the illustrated embodiment, this means has been effected by a resilient endless loop 42 which tightly encircles the adjacent members. In the illustrated embodiment resilient endless loop 42 is a coil expansion spring having one end attached or coupled to its other end to form a circle. Members 16 and 18 are passed through the center of the circle. The space provided by the center of the circle is slightly smaller than that which would be required to allow two dowels, such as members 18 and 16, to slip through. Thus, the encircling coil spring binds the dowels together in whatever the relation the dowelings are held with respect to each other. The spring constant of the coil spring and the friction between the dowels is sufficient so that when assembled as illustrated in FIG. 1 the dowels are substantially fixed one with the other. In other words, the forces which are encountered by the ordinary weight of the hand which the artist would rest against member 16 is insufficient to overcome the starting frictional resistence between the dowels and coil spring. However, the starting friction is not so great as to prohibit the easy and convenient manual adjustment of members 16 and 18 one with each other. As shown in FIG. 1, member 18*a* is positioned above and rests on offset members 16*a* and 16*b* so that coupling 42 does not support the weight of the artist's hand. By juxtapositioning member 18*a* above and on members 16*a* and 16*b*, the weight of the hand is entirely transferred to offset members 16*a* and 16*b*. The strength of the apparatus is therefore limited only by the structural strength of members 14, 16 and 18 and not by the strength of coupling 42. However, it is to be expressly understood that many other means other than an endless coiled spring could be employed. For example, an endless resilient or elastic cord or bands would be regarded as equivalent. A number of mechanical equivalents are also possible, such as a mechanical universal joint or a slip collar fitted with a ball and socket pivot.

Although the present invention has been described with respect to a single embodiment many other alterations and modifications may be made by those having ordinary skill in the art without departing from the scope and spirit of the present invention. For example, a custom designed support could be included as part of the present invention, to which support the offset members would be slidingly engaged, such as in a locking track paralleling the horizontal and vertical perimeters of the work object. For horizontal or near horizontal work objects, the offset members could take the form of magnetized bars framing, at least in part, the work object with a ferromagnetic rest member spanning the magnetized offset members.

I claim:

1. An apparatus for providing a steadying rest adjacent a work surface having at least two dimensions comprising:

at least one offset member;

attaching means for temporarily coupling said offset member to a selected position adjacent said work surface;

a first rest member;

adjustable coupling means for coupling said first rest member to said offset member and providing said steadying rest;

said coupling means frictionally engaging said offset member whereby said first rest member can be adjustably positioned by movement of said coupling means in the proximity of substantially any point of said work surface without the necessity of continued manual assistance;

said coupling means being adjustably positioned by a force overcoming the starting frictional resistance between said coupling means on said offset member;

said adjustable coupling means also frictionally engaging said first rest member permitting relative rotation and translation of said first member relative to said coupling means by a force overcoming the starting frictional resistance with said coupling means.

2. The apparatus of claim 1 further comprising:

an additional offset member; and a second rest member adjustably coupled to said first rest member and to said additional offset member by coupling means identical to said first coupling means to provide the sole support of said second rest member;

wherein second attaching means also temporarily couples said additional offset member to a selected position adjacent said work surface; and whereby an apparatus is configured to provide at least a two-dimensionally extending steadying rest in the proximity of substantially any point of said work surface.

3. The apparatus of claim 1 wherein two offset members are each coupled to said first rest member by two of said coupling means, two of said attaching means coupling each said offset member to a corresponding position adjacent said work surface.

4. The apparatus of claim 1 wherein said coupling means is a resilient endless loop encircling said offset and rest members.

5. The apparatus of claim 2 wherein said second rest member is adjustably coupled to said first rest member by adjustable coupling means frictionally engaging both said first and second rest members while permitting relative rotation and translation of said rest members by a force overcoming the starting frictional resistance.

6. An apparatus for providing a steadying rest adjacent a work surface having at least two dimensions comprising:

at least one offset member;

attaching means for temporarily coupling said offset member to a selected position adjacent said work surface;

a first rest member;

adjustable coupling means for coupling said first rest member to said offset member and providing said steadying rest;

said coupling means frictionally engaging said offset member whereby said first rest member can be adjustably positioned by movement of said coupling means in the proximity of substantially any point of said work surface without the necessity of continued manual assistance;

said coupling means being adjustably positioned by a force overcoming the starting frictional resistance between said coupling means and said offset member;

said adjustable coupling means also frictionally engaging said first rest member permitting relative rotation and translation of said first member relative to said coupling means by a force overcoming the starting frictional resistance with said coupling means;

an additional offset member;

a second rest member adjustably coupled to said first rest member and to said additional offset member by coupling means identical to said first coupling means to provide the sole support of said second rest member;

wherein said attaching means also temporarily couples said additional offset member to a selected position adjacent said work surface;

whereby an apparatus is configured to provide at least a two-dimensionally extending steadying rest in the proximity of substantially any point of said work surface;

said second rest member being adjustably coupled to said first rest member by adjustable coupling means frictionally engaging both said first and second rest members while permitting relative rotation and translation of said rest members by a force overcoming the starting frictional resistance; and said coupling means being a resilient endless loop encircling said offset and rest members.

7. A steadying rest to aid in steadying an artist's hand over a two-dimensional work surface comprising:

at least three offset members;

attaching means for temporarily fixing each of said offset members with respect to said work surface;

at least two rest members adjustably coupled to said offset members; one of said rest members being adjustably coupled to two of said offset members, and the other rest member being adjustably coupled solely to a third one of said offset members and to said one rest member;

all of said adjustable couplings comprising means frictionally engaging each of the two coupled members to permit movement of each coupled member relative to the other by a force overcoming the frictional engagement.

* * * * *